United States Patent [19]

Kasprzyk

[11] Patent Number: 4,690,324

[45] Date of Patent: Sep. 1, 1987

[54] OIL BURNER CONTROL FOR HYDRONIC SYSTEM

[75] Inventor: Donald J. Kasprzyk, Maple Grove, Minn.

[73] Assignee: Honeywell Inc., Minneapolis, Minn.

[21] Appl. No.: 879,733

[22] Filed: Jun. 27, 1986

[51] Int. Cl.[4] ..... F24D 3/00

[52] U.S. Cl. ..... 237/8 R; 236/21 B; 236/9 A

[58] Field of Search ..... 237/8 R, 56, 19, 7; 236/9 A, 94, 91 F, 91 B, 21 B

[56] References Cited

U.S. PATENT DOCUMENTS 4,298,165 11/1981 McKinley ..... 237/8 R
4,470,541 9/1984 Raleigh ..... 237/8 R X

OTHER PUBLICATIONS

"Combination Protectorelay and Hydronic Heating Controls"—R8182 Honeywell Form Number 60-21-42-5, dated 8-85.

"Protectorelay Oil Burner Controls"—R4184 Honeywell Form Number 60-2071-2, dated 3-76.

"Aquastat Relays"—L8124 Honeywell Form Number 60-2061-4, dated 3-83.

*Primary Examiner*—Henry A. Bennett
*Attorney, Agent, or Firm*—Alfred N. Feldman

[57] ABSTRACT

An integrated oil burner control and hydronic limit control arrangement is disclosed. A single transformer energizes the oil burner control and all of the equipment necessary to both operate an oil burner and a circulator pump. This type of device can be implemented in either a simple hydronic type system or in a more complex hydronic system in which domestic hot water is also supplied.

5 Claims, 2 Drawing Figures

OIL BURNER CONTROL FOR HYDRONIC SYSTEM

BACKGROUND OF THE INVENTION

Oil fired boilers have long been used to supply hot water for hydronic heating. The hydronic heating can entail both the heating of an occupied space and for domestic hot water. These types of systems typically use separate oil burner controls and boiler water temperature limit controls.

A typical oil burner fired boiler can be controlled by an oil burner control such as a control manufactured by Honeywell and identified as an R4184 or an R8184. This type of a control utilizes a cadnium sulfide flame sensor to respond to a flame in an oil burner. This control typically would be responsive to a room thermostat and would contain its own step-down or power transformer.

Used in conjunction with an oil burner control for hydronic space heating there is usually provided a boiler water temperature limit control such as that sold by Honeywell and identified as an L8148. This type of control is referred to in the trade as an Aquastat Relay. This control typically contains its own power transformer and related circuitry.

Where a system involves domestic hot water, the system typically would use a more complex boiler water temperature limit control which has two sets of contacts. This type of control is sold by Honeywell as an L8124 and is known as a triple Aquastat Relay. This control contains its own transformer and circuitry, along with high-limit contacts and a pair of low-limit contacts. The high-limit contacts protect the boiler against excessive boiler water temperatures, while the low-limit contacts are used to insure that the water temperature in the boiler is never allowed to drop below a level needed to supply the domestic hot water.

The combination of an oil burner control and a boiler water temperature limit control works quite well, but is very large and expensive. The size and expense is dictated by the fact that each of the controls is independent of one another, and contain their own power transformers and circuitry. This type of equipment is becoming more and more difficult to apply to specific boiler applications due to the cost of two separate units and the physical space that the two units require. For these reasons, this type of equipment, while functionally adequate, is less and less competitive.

SUMMARY OF THE INVENTION

The present invention is directed to a control system for an oil burner heated boiler which supplies hot water for a hydronic space heating system and for domestic hot water. The present unique control has a single transformer and simple relay configuration that is capable of providing the necessary energizing power and control functions that have been previously accomplished by two expensive, complex, and space consuming units. The present control still can be made up of two units, one of which is a simplified Aquastat Relay. The present invention not only allows for a reduction in physical size and components, but provides a significant cost savings over the types of control systems used and sold in the present day marketplace.

In accordance with the present invention there is provided a control for an oil burner heated boiler connected to a hydronic system having a circulator, including: oil burner control means adapted to be controlled by a thermostat; said burner control means further including relay means having a plurality of normally open relay contacts with said contacts being operated to a closed state in response to the operation of said thermostat; a first of said relay contacts latching said relay means into an operated state upon operation of said thermostat; boiler water temperature limit control means having a high temperature limit switch that open circuits upon the water in said boiler reaching an upper temperature limit; said limit control means including a further switch that closes when said high temperature limit switch opens; said high temperature limit switch connecting said oil burner control means, said oil burner, and a second normally open relay contact of said relay means in first circuit means which is adapted to be connected to a line voltage source to energize said oil burner and said oil burner control means when said water in said boiler is below said upper temperature limit; and circulator energizing means including second circuit means adapted to connect said circulator to said line voltage source through said further switch means when said further switch means closes to cause said circulator to operate when said high temperature limit switch is open circuited.

DESCRIPTION OF THE PREFERRED EMBODIMENTS

Figure 1:
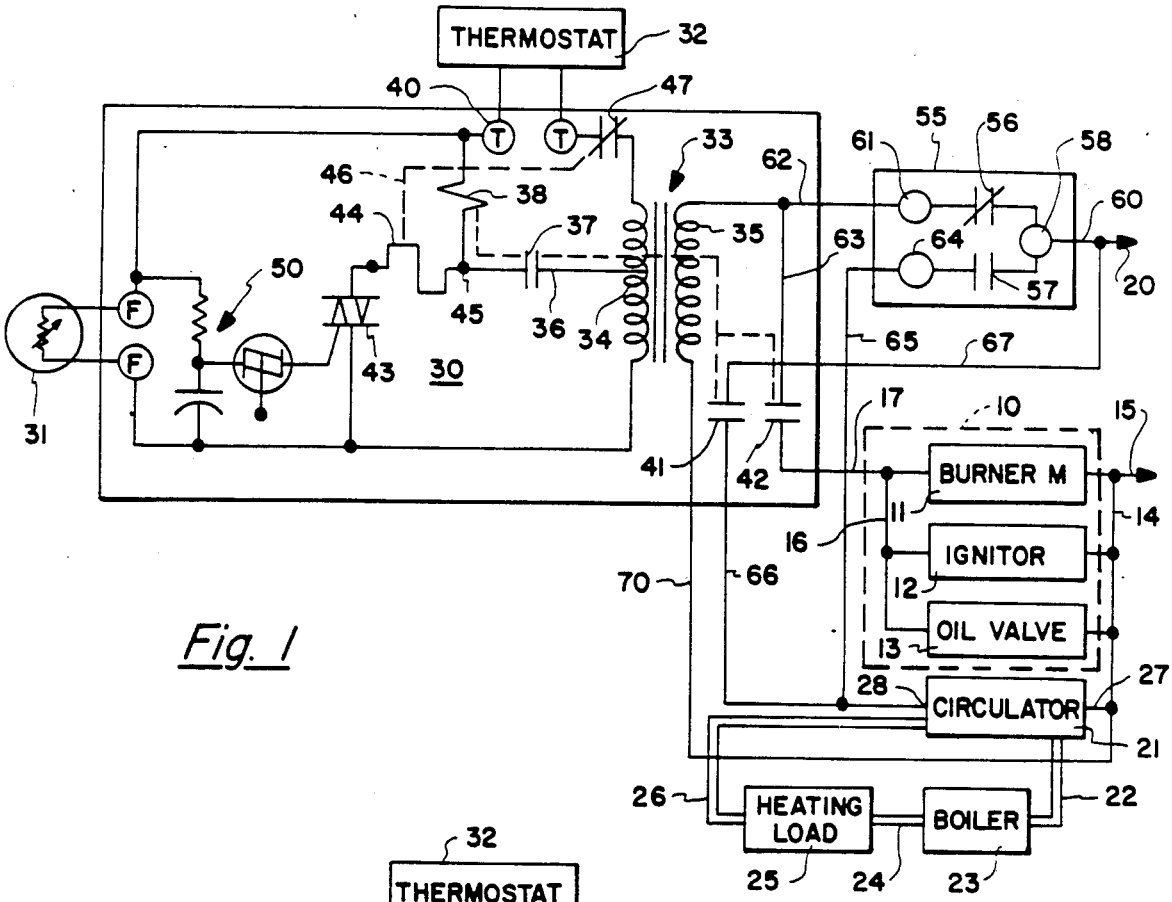
FIG. 1 is a circuit diagram of a hydronic system.

FIG. 1 discloses an oil burner 10 including a burner motor 11, an ignition means 12, and an oil valve 13. The oil burner 10 is of conventional design and has been shown schematically. The burner motor 11, the igniter 12, and the oil valve 13 are connected to a common conductor 14 that in turn is connected to one terminal 15 of a line voltage source of potential. The burner motor 11, the igniter 12, and the oil valve 13 are further connected by a common conductor 16 to a conductor 17 that eventually is connected by the novel control of the present invention to a second line terminal 20 to appropriately energize the oil burner 10.

Included in the system is a circulator or pump 21 that is connected by appropriate piping 22 to a boiler 23. The boiler 23 is connected by a pipe 24 to a heating load 25, which in turn is connected by piping 26 back to the circulator 21. The circulator 21, boiler 23, and the heatirg load 25 are all conventional, and are disclosed to provide an enabling disclosure for the present invention. The circulator 21 is connected at 27 to the conductor 14, and at 28 to further conductors which are adapted to be connected to the control system. The elements described to this point are conventional and are well understood in this particular art.

An oil burner control 30 is disclosed and is of a type generally used in the oil burner industry. The oil burner control is in some ways similar to the Honeywell R8184, previously mentioned. The oil burner control responds to a cadmium sulfide sensor 31 which is exposed to the flame within the oil burner. The control is further adapted to be connected to a thermostat 32 of conventional design. The oil burner control 30 is energized from a step-down transformer 33 which has a tapped secondary winding 34 and a primary winding 35. The tapped winding 34 is connected by a conductor 36 through a relay contact 37 to a relay means 38. The relay means 38 in turn is connected to a terminal 40 for the oil burner control 30, and which is one of the terminals for the connection of the thermostat 32. The relay means 38 has two further normally opened relay contacts 41 and 42 that will be described as far as function are concerned at a subsequent point in this disclosure.

The oil burner control 30 utilizes a solid state switch 43 that is connected through a safety switch heater 44 to a common point 45 between the relay means 38 and the contact 37. The safety switch heater 44 is functionally connected at 46 to a safety switch contact 47 in a conventional manner. The solid state switch 43 is controlled through a network, generally disclosed at 50, by the variation of resistence of the cadmium sulfide cell 31.

Also provided in this system is a boiler water temperature limit control means 55. This temperature limit control means could be of a type known as an L6006 Aquastat Controller as sold by Honeywell. This limit control means 55 is mounted at the boiler 23 and is in a temperature exchan9e relationship with the water in the boiler 23 to control a pair of contacts 56 and 57. The contacts 56 and 57 could be in the form of a single pole, double throw switch. The contacts 56 and 57 are connected jointly at 58 to a conductor 60 that is in turn connected to the source of potential 20. Contact 56 is connected at a terminal 61 to a conductor 62 that supplies power to one end of the primary winding 35, and is further connected at 63 to the relay contact 42. The relay contact 42 is in turn connected to the conductor 17 to supply power (when the contact 42 is closed) to the oil burner 10. The contact 57 is connected to a terminal 64 that in turn is connected to a conductor 65 and to the circulator 21 at point 28. It should be noted that the contact 56 is normally closed and the contact 57 is normally open. Upon a temperature rise in the boiler 23, the contact 56 will open and the contact 57 will close as soon as the temperature in the boiler reaches some pre-determined maximum temperature.

The present circuitry is completed by providing a conductor 66 between the contact 41 and the circulator 21 to supply power from a conductor 67 from the voltage terminal 20. The primary winding 35 of the step-down transformer 33 is connected by a conductor 70 to the common conductor 14 and the terminal 15.

OPERATION FIG. 1

Upon a call for heat from the thermostat 32, the oil burner control 30 is activated by closing the circuit between the terminal 40 and the safety switch contact 47. Power is supplied to the transformer 33 from the primary winding 35 through the normally closed contact 56 of the boiler water temperature limit control means. It is assumed that there is no flame in the oil burner combustion chamber, and the cadmium sulfide sensor 31 allows the solid state switch 43 to conduct. This allows current to flow through the relay means 38 which energizes the relay 38. Its operation closes the contacts 37, 41, and 42. The contact 37 locks the relay in through the safety switch 47 and the thermostat 32, in a conventional manner. The closing of the contacts 41 and 42 place the system in operation. The closing of contact 42 completes an energizing circuit for the oil burner 10 allowing power to be provided from the terminal 20 through the normally closed contact 56 to the conductor 63 and then to the common conductor 16. At this same time a circuit is completed through the conductor 67 and the closed contact 41 to the circulator 21. As such, the oil burner 10 becomes active and the circulator 21 begins to circulate water from the boiler through the heating load 25. At this same time the cadmium sulfide cell 31 effectively shorts out the control circuit 50 for the solid state switch 43 and stops the heating of the safety switch heater 44 to thereby allow only the thermostat 32 to control the operation of the system.

At some point in time, the temperature at the boiler water temperature limit control means 55 can rise and the switch 56 opens with the switch 57 simultaneously closing. This removes power from the transformer 33 to deactivate the oil burner 10. The closing of the contact 57 connects the power terminal 20 to the conductor 65 and the circulator 21 back to the terminal 15. As such, the circulator operates to move the heated water from the boiler while the oil burner 10 has been taken out of operation.

During normal operation, under control of the thermostat 32, the oil burner 10 and circulator 21 operate through the contacts 41 and 42. In the event that the boiler 23 reaches a limit as determined by the boiler water temperature limit control means 55 (as described above), the oil burner 10 is deactivated but the circulator remains in operation to move the heated water to the heating load.

With the present circuit a simple boiler water temperature limit control arrangement is provided that utilizes a single transformer 33 to power all of the necessary control circuitry and allows for a significant reduction in size, weight, and costs over the systems currently in use.

Figure 2:
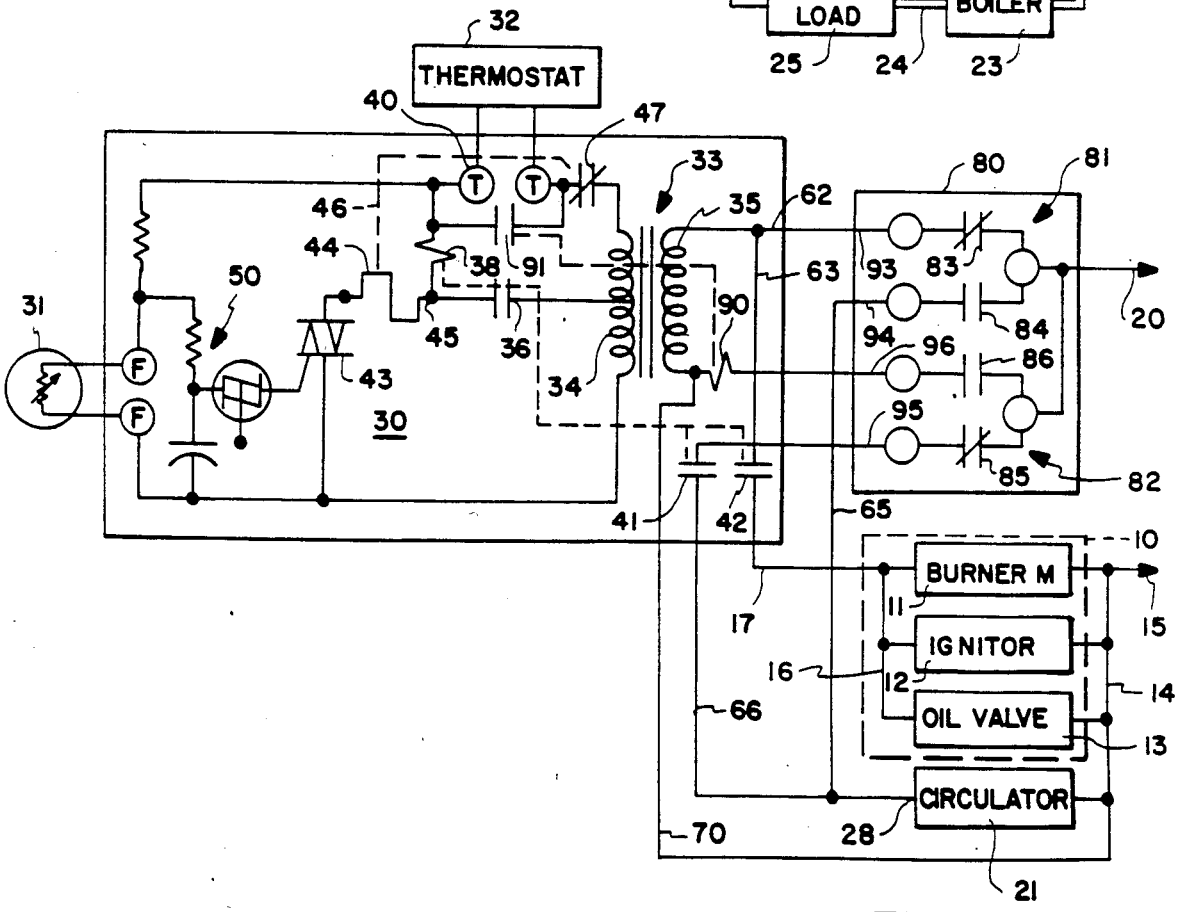
FIG. 2 is a schematic drawing of a hydronic system incorporating domestic hot water.

In FIG. 2 a system is disclosed that utilizes a common concept with FIG. 1, but is adapted to operate a boiler system that also supplies domestic hot water. The elements that are common will have common reference numbers. Also, as a matter of convenience the boiler 23, the heating load 25, and the associated piping has been deleted from the disclosure of FIG. 2. Only newly added or different elements will be described in detail before a description of operation is provided.

A boiler water temperature control means 80 having two sets of contacts 81 and 82 is disclosed. The set of contacts 81 includes a normally closed contact 83 and a normally open contact 84. The normally closed contact 83 opens on a high temperature limit, and the contact 84 closes at the same time. The other set of contacts 82 has a low temperature limit contact 85 and a related contact 86. The contact 85 open circuits when a selected low limit has been reached, and the contact 86 simultaneously closes. The boiler water temperature limit control means 80 thus is capable of protecting the boiler 23 against high temperatures and also provides a control function to insure that the circulator and associated equipment will operate at or above some set lower limit. This is necessary to provide adequate domestic water that is hot enough for use even though the space temperature may not be calling for the operation of the system. The contacts 83 and 84, along with the contacts 85 and 86, all are commonly connected to the terminal 20. Contact 83 further has a conductor 93 while the contact 84 has a conductor 94. The contacts 85 and 86 have similar conductors 95 and 96 so that the boiler water temperature limit control means 80 can be connected into the circuit. The conductor 93 is connected to the conductor 62. The conductor 94 is connected to the conductor 65 to the circulator 21. The conductor 96 is connected to a second relay means 90 that controls a contact 91 that operates in tandem with the thermostat 32. The closing of the contacts 91 simulates the operation of the thermostat 32 as will be described subsequently. The conductor 95 is connected to the contact 41 that ultimately is connected to the conductor 66 for the circulator 21.

OPERATION OF FIG. 2

When the thermostat 32 calls for the operation of the system, the relay means 38 is again energized through the solid state switch 43. The contact 36 locks the relay means 38 into an energized condition and closes the contacts 41 and 42. This arrangement supplies power to the burner 10 and to the circulator 21 as was true in connection with FIG. 1. When flame appears in the burner, the cadmium sulfide sensor 31 deactivates the solid state switch 43 that in turn deactivates the safety switch heater 44 to leave the system under the control of the thermostat 32.

At this time the contact 83 (which is a high limit) is closed to supply power to the burner 10 and the circulator 21. The circulator 21 operates from power supplied on conductor 66 through the contact 41 and through the normally closed contact 85 to the power source 20. This in effect is the normal operation of the system. If the temperature of the boiler water rises above the limit set for the control 80, the contact 83 opens, and the contact 84 closes. This is similar to FIG. 1. In this case the circulator 21 continues to operate, but the power is removed from transformer 33 to deenergize the oil burner 10.

In the event that the thermostat 32 is open thereby not calling for space heating, and the temperature of the boiler water drops below a level desirable for supplying domestic hot water, the contact 85 will open circuit and the contact 86 will be closed. The closing of the contact 86 supplies power from the terminal 20 to the conductor 96 to the relay means 90. Relay means 90 is then energized pulling in the contact 91 that is operated in tandem with the thermostat 32. The system is now under the control of the contact 91 and will cause the oil burner 10 to be energized to supply a sufficient level of hot water for the domestic hot water needs for the system connected to the device of FIG. 2.

In the event that the thermostat 32 then calls for heating, the system will revert to its original state since the heating of the water in the boiler 23 by the oil burner 10 will cause the contact 85 to close and the contact 86 to open, thereby placing the system back in the condition it was in when the low limit operation of the contact 85 was necessary.

As can be seen in FIG. 2 a complete system for both hydronic heat of an enclosed space, and for domestic hot water has been provided with the use of a single transformer and integrated boiler water temperature limit control means 80. The systems of FIGS. 1 and 2 use the same concept in their utilization of a single oil burner control and transformer for both the oil burner operation and the necessary control of the circulator for the system. It is apparent that many variations of the present concept can be implemented and the inventor wishes to be limited in the scope of his invention solely by the scope of the appended claims.

The embodiments of the invention in which an exclusive property or right is claimed are defined as follows:

1. A control for an oil burner heated boiler connected to a hydronic system having a circulator, including: oil burner control means having a step-down transformer and connection means for powering said oil burner control means and adapted to be controlled by a thermostat; said burner control means further including relay means having a plurality of normally open relay contacts with said contacts being operated to a closed state in response to the operation of said thermostat; a first of said relay contacts latching said relay means into an operated state upon operation of said thermostat; boiler water temperature limit control means having a high temperature limit switch that open circuits upon the water in said boiler reaching an upper temperature limit; said limit control means including a further switch means that closes when said high temperature limit switch opens; said high temperature limit switch including connection means connecting said oil burner control means, said oil burner, and a second normally open relay contact of said relay means in a first circuit means which is adapted to be connected to a line voltage source to energize said oil burner and said oil burner control means when said water in said boiler is below said upper temperature limit; and circulator energizing means including a second circuit means adapted to connect said circulator to said line voltage source through said further switch means when said further switch means closes to cause said circulator to operate when said high temperature limit switch is open circuited.

2. A control as claimed in claim 1 wherein a third normally open relay contact of said relay means is connected in further relay controlled circuit means which is adapted to be connected to said line voltage and said circulator to energize said circulator upon operation of said relay means.

3. A control as claimed in claim 2 wherein said further relay controlled circuit means is adapted to energize said circulator upon operation of said relay means independently of said second circuit means which operates said circulator through said further switch means of said boiler water temperature limit control means.

4. A control as claimed in claim 3 wherein said boiler water temperature limit control means includes low temperature limit switch means with a normally closed low limit switch contact and a normally open low limit switch contact; said normally closed low limit switch contact and said third normally open relay contact adapted to be connected to said line voltage source to control said circulator.

5. A control as claimed in claim 4 wherein said switch contact is connected to second relay means; said second relay means having a normally open contact connected to energize said oil burner control means in tandem with said thermostat; said second relay means contact closing to energize said oil burner control means when said low limit switch means operates to insure a minimum supply of hot boiler water for said system.

* * * * *

UNITED STATES PATENT AND TRADEMARK OFFICE

CERTIFICATE OF CORRECTION

PATENT NO. : 4,690,324

DATED : September 1, 1987

INVENTOR(S) : DONALD J. KASPRZYK

It is certified that error appears in the above-identified patent and that said Letters Patent is hereby corrected as shown below:

Claim 5, Column 6, line 55, after "said", insert --normally open low limit--.

Signed and Sealed this

Twelfth Day of January, 1988

*Attest:*

*Attesting Officer*

DONALD J. QUIGG

*Commissioner of Patents and Trademarks*